United States Patent [19]

Sensibaugh

[11] Patent Number: 4,794,399

[45] Date of Patent: Dec. 27, 1988

[54] RETRACTION ALARM FOR EXTERIOR TELEVISION ANTENNA OR RV ANTENNA

[76] Inventor: Ed Sensibaugh, P.O. Box 1084, Dayton, Nev. 89403

[21] Appl. No.: 892,372

[22] Filed: Aug. 4, 1986

[51] Int. Cl.[4] ..... H01Q 3/00

[52] U.S. Cl. ..... 343/760; 343/882; 343/894

[58] Field of Search ..... 343/760, 880, 881, 882, 343/894

[56] References Cited

U.S. PATENT DOCUMENTS

| | | | |
|---|---|---|---|
| 2,214,685 | 9/1940 | Stone, Jr. | 343/882 |
| 2,659,075 | 10/1953 | Collins et al. | 343/760 |
| 3,665,477 | 5/1972 | Budrow et al. | 343/882 |
| 3,739,387 | 6/1973 | Budrow et al. | 343/882 |
| 3,878,957 | 4/1975 | Rempel | 414/486 |
| 4,101,897 | 7/1978 | Morrison | 343/882 |
| 4,254,419 | 3/1981 | Noddin | 343/882 |
| 4,572,934 | 2/1986 | Johnston | 200/222 |

*Primary Examiner*—William L. Sikes
*Assistant Examiner*—Hoanganh Le
*Attorney, Agent, or Firm*—Thorpe, North & Western

[57] ABSTRACT

An alarm device for signaling the need to retract an exterior television antenna mounted to a recreational vehicle or motor home. The device includes a switch capable of signaling a projecting orientation of the TV antenna, as opposed to a retracted position of the antenna against the vehicle. The switch is coupled to the antenna by means of a bracket or brace which is used to control the specific orientation which triggers operation of the switch. An alarm is coupled to the switch and is responsive to the detected condition of an extended antenna to thereby generate a warning for a driver of the vehicle. The alarm is coupled in series with the switch, a power source and the ignition system of the vehicle. When the driver attempts to start the vehicle, the alarm device checks the condition of the antenna and alerts the driver if the antenna is not in the safe, retracted position.

4 Claims, 2 Drawing Sheets

RETRACTION ALARM FOR EXTERIOR TELEVISION ANTENNA OR RV ANTENNA

BACKGROUND OF THE INVENTION

1. Field of the Invention

This invention relates to exterior antennas on recreational vehicles such as are used for television reception. More specifically, the present invention relates to a device for signaling an alarm which warns the driver to retract an extended television antenna prior to moving the vehicle 2. Prior Art:

Most larger recreational vehicles which are adapted with living quarters also include a television and built-in television antenna at the roof of the vehicle. Typically, such an antenna is collapsible as shown in U.S. Pat. Nos. 3,665,477 and 3,739,387 by Budrow, et al. 3,587,104, also by Budrow, shows another embodiment relating to this field of exterior antennas.

The pattern of use for such a collapsible antenna begins as the recreational vehicle is pulled to a stationary position where the occupants intend to view the television and need to improve reception. In such instances, the occupants will extend the antenna and rotate to a proper orientation for best reception.

The referenced patents disclose various embodiments for collapsible antennas which may be oriented and extended by use of manual controls attached at the interior ceiling of the recreation vehicle. Typically, such manual controls involve the use of a rotatable lever which is mechanically coupled to the exterior antenna. Rotation of the lever causes the antenna assembly to extend in an appropriate upright configuration for reception. Reverse rotation of the lever causes the antenna to retract to its lowered position The importance of being able to retract the antenna to a lower position is apparent because of the vulnerable condition of the antenna as the vehicle moves. For example, the RV may brush under a tree or encounter low objects overhead which can strike the antenna structure and severely damage or rip it free from the RV.

Although prior art structures have provided mechanical means for extending and retracting the RV antenna, such structure relies upon the memory of the occupant to retract the antenna prior to moving the vehicle. It is not uncommon, therefore, for an RV driver to prepare his recreational vehicle for road travel yet inadvertently fail to recall that the television antenna is in the extended position Upon moving within the RV park, the antenna may strike a low hanging tree or other object and cause permanent damage to the antenna system.

What is needed, therefore, is an alarm device which allerts the driver to the extended position of the television antenna on the exterior of his recreational vehicle The inventor is unaware of any prior art which suggests a solution to this problem. U.S. Pat. No. 2,214,685 shows an interesting antenna assembly for a police car which is designed to allert the driver when the antenna has been dislocated from its vertical position. This structure operates in a direct opposite manner, however, from that which is needed. Indeed, the 685 patent previously indicated fails to even suggest that an alarm should be provided to give notice that the antenna is fully extended.

OBJECTS AND SUMMARY OF THE INVENTION

Accordingly, it is an object of the present invention to provide an alarm device for warning the driver of a recreational vehicle that an attached TV antenna is in an upright, projecting or other vulnerable orientation or position It is a further object of the present invention to provide such an alarm device which automatically activates if the antenna is extended when the ignition of the vehicle is started.

These and other objects are realized in a retraction alarm device which includes a position indicating mercury switch means capable of signaling the occurrence of a condition for the exterior antenna wherein the antenna has been at least partially extended toward the projecting position with respect to the vehicle. The switch means is attached to the antenna by an attachment means which properly locates the switch means to enable detection of the non-retracted condition of the antenna. An alarm means is electrically coupled to the switch means and is responsive to the detection of the extended condition of the antenna. When this condition is detected, the alarm generates a light and/or sound signal giving notice to the driver of the vehicle that the antenna is not retracted. The system is attached to the vehicle battery at the ignition circuit so that initial vehicle start up also powers the retraction alarm device and scans for the alarm condition. Accordingly, as the driver of the vehicle turns on the ignition key, an extended condition of the TV antenna will activate the alarm signal, warning the driver to retract the antenna before movement Other objects and features of the present invention will be apparent to those skilled in the art in view of the following detailed description, taken in combination with the drawings

DETAILED DESCRIPTION OF THE INVENTION

Figure 1:
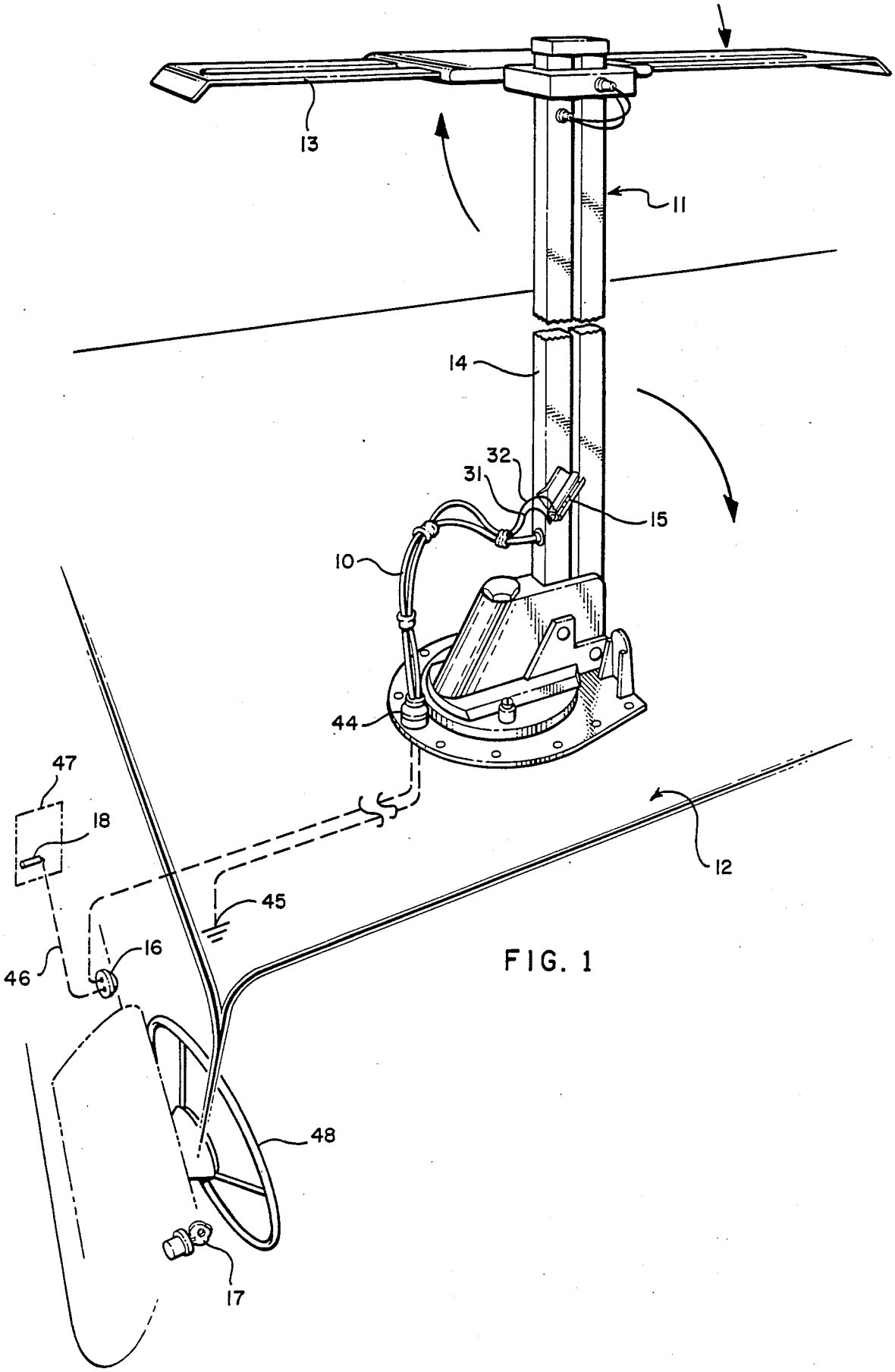
FIG. 1 is a perspective view of the subject retraction alarm device coupled to an extended TV antenna mounted at the roof of a motor home or recreational vehicle.
Figure 2:
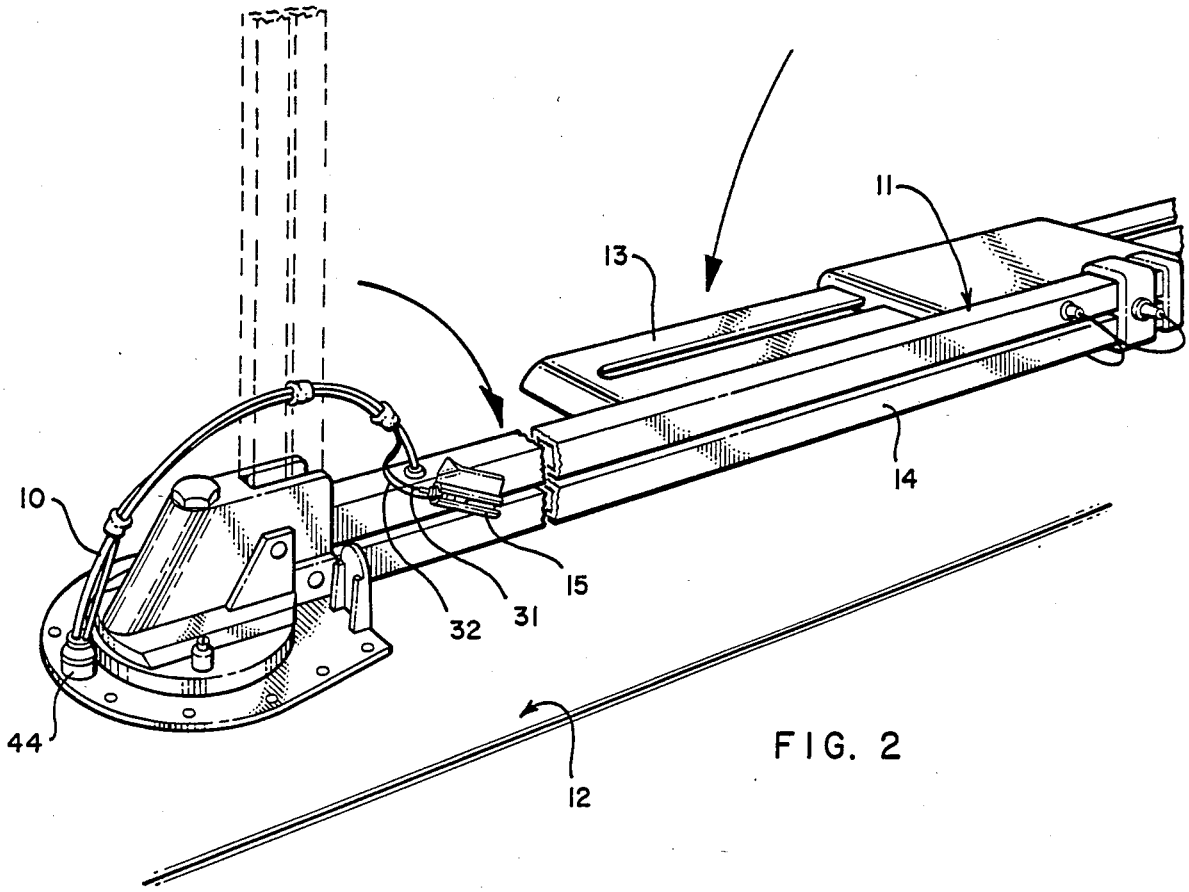
FIG. 2 shows the subject invention with the antenna in the retracted position.

FIG. 1 shows an antenna 11 and coaxial cable 10 of conventional design for use with a mobile home 12. This horizonally polarized antenna which must be movable both vertically and horizontally, is used for television reception and is collapsible or retractable to a stored position such as is illustrated in FIG. 2. In this configuration, the receptor element 13 is rotated 90 degrees to a parallel orientation with the stem of the antenna 14. In this retracted position, the antenna is protected against collision with trees or other ovrrhanging objects which can damage the antenna structure upon impact.

The retraction alarm dvvice comprises a switch means 15 for indicating relative position of the antenna 11 with respect to the recreational vehicle 12. Specifically, the switch 15 detects the occurrence of a condition wherein the antenna has been at leatt partially extended toward the projecting position illustrated in FIG. 1. This projecting or partially projecting condition is contrasted with the opposing condition illustrated in FIG. 2 wherein the antenna has been retracted to a safe position proximate to the vehicle.

Switch 15 is electrically coupled to an alarm means 16 which is responsive to detection of the extended condition of the antenna. This alarm may be an audio source, light or combination of audio and light for giving notice to the driver of the vehicle regarding the extended condition of the antenna. The device is coupled to battery power of the vehicle through the ignition circuit associated with the vehicle ignition key 17 and fuse 18 in the vehicle fuse box.

Figure 3:
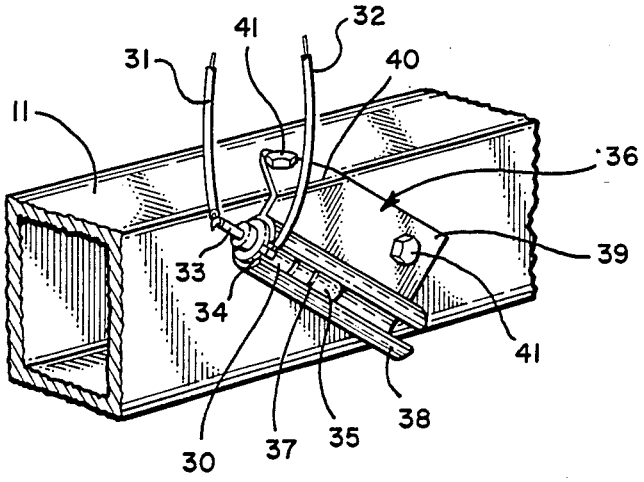
FIG. 3 is an enlarged view of the retraction alarm device as shown in FIG. 2.

The subject disclosure identifies a preferred embodiment utilizing a mercury leveling switch of tubular construction as is best illustrated in FIG. 3. Disclosed is a commercially available mercury switch 30 which includes leads 31 and 32 which are electrically insulated from each other at contacts 33 and 34. These contacts extend to the interior of the mercury switch and are only electrically coupled when the liquid mercury 35 flows over the two contacts 33 and 34 to close the circuit and allow current flow through leads 31 and 32.

A clamp 36 serves as attachment means for positioning the mercury switch 30 in an operable position to detect the projected orientation of the antenna. Specifically, the fluid level 37 of the liquid mercury is controlled by the position of the attachment clamp 36 to the antenna 11 and the relative orientation of the antenna. This clamp comprises a tubular housing 38 sized to provide a tight fit for the mercury vial or switch 30. Coupled to the tubular housing is a flange 39 which has one corner bent 40 to wrap around the antenna 11. This corner is bolted 41 to the antenna in a position such that the mercury vial 30 is upright as shwwn when the antenna 11 is in the retracted position. Such an upright orientation results in gravity flow of the mercury 35 to the free end of the mercury vial 30. Because contacts 33 and 34 are free of the mercury liqudd 35, current flow through leads 31 and 32 is blocked, preventing the alarm signal.

When the antenna 11 is raised to a vertical position, the mercury liquid 35 shifts position to the other end of the mercury vial 30. Both interior contacts 33 and 34 are covered by the liquid mercury to close the circuit between leads 31 and 32. This causes the signal to activate when the circuit is powered.

Leads 31 and 32 extend through a grammet 44 to a grounding location 45 and to the alarm device 16. The illustrated alarm means 16 is a lighted display which reads ANTENNA when lighted to warn the driver of the extended position of the antenna. A buzzer may be coupled within the circuit to give audio signal at the same time that the light is activated. It will be apparent to those skilled in the art that many warning devices might be combined with the disclosed invention to alert the driver of the need to retract the antenna to its closed position.

The circuitry of the alarm device is powered by a wire lead 46 which is coupled between the alarm 16 and fuse box 47 By attaching this lead to the ignition side of a fuse, power supply occurs nnly when the vehicle ignition is in the "on" position. This feature causes notification of the extended antenna position to occur when the ignition key 17 is turned on by a driver. Therefore, before the driver is able to move the motor home or recreation vehicle, he or she receives ample notice that the antenna is extended in a vulnerable position. Specifically, as the ignition key is turned to the "on" position, a closed circuit between leads 31 and 32 occurs by virtue of the mercury liquid contact at both contact points 33 and 34. Battery power causes the alarm 16 to activate and warn the driver before the vehicle is actually moved. The placement of the alarm means near the steering wheel 48 and ignition key 17 provides convenient observation of an alarm condition even when the driver is forgetful and does not consciously check the alarm for a warning condition.

It will be apparent to those skilled in the art that numerous variations with rsspect to the disclosed invention are possible. Accordingly, it is to be understood that the scope of the present invention is not limited by the disclosed embodiment, but only by the following claims.

I claim:

1. A retractional alarm device for use with an exterior horizontally and vertically movable roof-mounted television antenna which is mounted in projecting orientation with respect to a recreational vehicle such as a motor home; said alarm comprising:

a. mercury leveling switch means of a tubular construction including position indicating means capable of signalling the occurrence of a condition for the exterior antenna wherein the antenna has been at least partially extended toward the projecting position, thereby increasing the vulnerability of the antenna to possible impact with foreign objects, as contrasted with an opposing condition wherein the antenna has been retracted to a safe position proximate to the vehicle, thereby being partially shielded from impact with foreign objects;

b. attachment means connected to the switch means and being operable to position the switch means with respect to the antenna to enable detection of the stated condition;

c. alarm means electrically coupled to the switch means and being operable to position the switch means with respect to the antenna to generate an alarm for giving notice to a driver of the vehicle; and d. power source attachment means for attachment between the switch means and a voltage source.

2. An alarm device as defined in claim 1, wherein the switch means comprises a mercury leveling switch which is coupled within an electrical circuit in series with the alarm means and is adapted for attachment to the antenna such that the mercury switch develops an open circuit when the antenna is in the retracted position and develops a closed circuit as the antenna is extended to thereby cause the alamm to activate.

3. An alarm device as defined in claim 1, wherein the alarm means comprises a lighted display which activates to give a visual notification signal of an extended antenna condition, said display including means for attachment to a dash board section near an ignition key location.

4. An alarm device as defined in claim 1, further comprising means for coupling the alarm means in series with an ignition circuit of the vehicle as the power source to thereby limit operation of the device to those periods in which the ignition circuit is active.

* * * * *